US012765679B2

(12) United States Patent
Li et al.

(10) Patent No.: US 12,765,679 B2
(45) Date of Patent: Oct. 20, 2026

(54) CHAIR WITH IMPROVED COMFORT

(71) Applicant: ZHEJIANG QINGGU FURNITURE TECHNOLOGY CO., LTD, Huzhou City (CN)

(72) Inventors: Gang Li, Huzhou City (CN); Liang Zhang, Huzhou City (CN)

(73) Assignee: ZHEJIANG QINGGU FURNITURE TECHNOLOGY CO., LTD, Huzhou (CN)

( * ) Notice: Subject to any disclaimer, the term of this patent is extended or adjusted under 35 U.S.C. 154(b) by 199 days.

(21) Appl. No.: 18/734,099

(22) Filed: Jun. 5, 2024

(65) Prior Publication Data

US 2024/0398123 A1 Dec. 5, 2024

(30) Foreign Application Priority Data

Jun. 5, 2023 (CN) ..... 202310656559.9

(51) Int. Cl.
*A47C 7/40* (2006.01)
*A47C 7/46* (2006.01)
*A47C 7/48* (2006.01)

(52) U.S. Cl.
CPC ..... *A47C 7/405* (2013.01); *A47C 7/46* (2013.01); *A47C 7/462* (2013.01); *A47C 7/48* (2013.01)

(58) Field of Classification Search
CPC ..... A47C 7/405; A47C 7/46; A47C 7/462
See application file for complete search history.

(56) References Cited

U.S. PATENT DOCUMENTS 3,059,971 A * 10/1962 Becker ..... A47C 1/023 297/353
5,501,507 A * 3/1996 Hummitzsch ..... A47C 7/46 297/284.4 X
5,704,689 A * 1/1998 Kim ..... A47C 7/405 297/301.4
6,709,058 B1 * 3/2004 Diffrient ..... A47C 31/126 297/316
6,843,530 B1 * 1/2005 Wu ..... A47C 7/38 297/284.3
6,938,956 B1 * 9/2005 Piretti ..... A47C 7/38 297/284.7
6,945,601 B1 * 9/2005 Wu ..... A47C 7/40 297/284.4 X
7,040,703 B2 * 5/2006 Sanchez ..... A47C 7/405 297/284.4

(Continued)

*Primary Examiner* — Rodney B White
(74) *Attorney, Agent, or Firm* — Jiwen Chen; Joywin IP Law PLLC

(57) ABSTRACT

A chair with improved comfort includes an upper backrest, a lower backrest, a backrest bracket, and a base. The backrest bracket is pivotally mounted on the base, and the upper backrest is pivotally mounted on the backrest bracket. The lower backrest is pivotally connected to the upper backrest. Additionally, a transfer rod and a transmission device are provided between the upper backrest and the base. When the backrest bracket tilts backward, the movement of the transfer rod relative to the backrest bracket drives the upper backrest to rotate relative to the backrest bracket, thereby reducing the angle between the upper backrest and the lower backrest to wrap around the user's back, achieving the function of wrapping along the back curve and improving comfort.

12 Claims, 11 Drawing Sheets

(56) References Cited

U.S. PATENT DOCUMENTS 7,303,232 B1 * 12/2007 Chen ..... A47C 7/38
297/284.7
7,396,082 B2 * 7/2008 Sanchez ..... A47C 7/405
297/284.4
7,475,946 B2 * 1/2009 Diffrient ..... A47C 7/38
297/411.33
7,585,028 B2 * 9/2009 Jenkins ..... A47C 7/004
297/284.7
7,625,046 B2 * 12/2009 Sanchez ..... A47C 7/402
297/284.4 X
7,980,631 B2 * 7/2011 Diffrient ..... A47C 7/38
297/115
8,272,691 B2 * 9/2012 Hsuan-Chin ..... A47C 7/46
297/284.4 X
8,308,240 B1 * 11/2012 Chou ..... A47C 7/462
297/284.4
8,408,647 B2 * 4/2013 Wu ..... A47C 7/445
297/285
8,579,376 B2 * 11/2013 Chen ..... A47C 7/46
297/353
9,480,340 B1 * 11/2016 Harlow ..... A47C 7/46
10,076,191 B2 * 9/2018 Chen ..... A47C 7/40
10,258,820 B2 * 4/2019 Harlow ..... A47C 7/46
10,272,282 B2 * 4/2019 Harlow ..... A47C 7/746
10,667,612 B2 * 6/2020 Matlin ..... A47C 7/38
10,694,855 B2 * 6/2020 Zhou ..... A47C 7/465
10,827,841 B1 * 11/2020 Tsai ..... A47C 7/405
10,960,263 B2 * 3/2021 Harlow ..... A47C 7/441
11,083,299 B2 * 8/2021 Matlin ..... A47C 3/20
11,369,203 B2 * 6/2022 Mazlish ..... A47C 7/46
11,432,649 B2 * 9/2022 Beech ..... A47C 1/022
11,596,236 B2 * 3/2023 Wu ..... A47C 7/462
11,617,445 B2 * 4/2023 Wu ..... A47C 7/462
297/284.7
11,744,375 B2 * 9/2023 DuFresne ..... A47C 1/023
297/284.3
11,800,933 B2 * 10/2023 Mazlish ..... A61H 15/0078
11,819,137 B2 * 11/2023 Matlin ..... A47C 7/38
12,342,944 B2 * 7/2025 DuFresne ..... A47C 7/029
12,376,681 B2 * 8/2025 Mazlish ..... A47C 7/46
2007/0057550 A1 * 3/2007 Beyer ..... A47C 7/445
297/284.4
2011/0215623 A1 * 9/2011 Tsai ..... A47C 7/402
297/301.1
2012/0193959 A1 * 8/2012 Chen ..... A47C 7/38
297/301.1
2012/0193962 A1 * 8/2012 Chen ..... A47C 7/402
297/353

* cited by examiner

CHAIR WITH IMPROVED COMFORT

TECHNICAL FIELD

The present invention relates to the field of furniture, and in particular to a chair with improved or enhanced comfort.

BACKGROUND TECHNOLOGY

With the improvement of people's quality of life, the requirements for common furniture such as sitting chairs or seats are getting higher and higher, which is mainly reflected in the comfort of use; sitting chairs are used in many scenarios, especially in offices, where people spend almost all their working hours. Therefore, providing people with a highly comfortable office chair is the goal pursued by manufacturers.

Currently, chairs with high comfort levels are generally leisure chairs or sofas. They often have thick, soft padding, providing a more comfortable sitting experience than office chairs. Due to their large size, they can incorporate more structures or devices to enhance comfort. These features are difficult to achieve in office chairs, especially regarding padding. Therefore, designing clever structures to increase the comfort of office chairs has become a key research direction for manufacturers.

There is a type of leisure chair where, when the user leans back, the backrest not only reclines but also curves to fit the spine's curvature, creating a wrapping sensation to enhance comfort. However, these leisure chairs are large and occupy significant space, making them unsuitable for office use. Furthermore, existing leisure chairs adjust using gas rods inside the backrest, which are slow to adjust, not smooth in movement, less effective, bulky, and costly. Thus, cleverly incorporating the functions of leisure chairs into office chairs through structural design has become the key to improving office chair comfort.

SUMMARY OF THE INVENTION

To address the above technical issues, the present invention provides a chair designed to enhance comfort, including an upper backrest, a lower backrest, a backrest bracket, and a base. The backrest bracket is rotatably mounted on the base, the upper backrest is rotatably mounted on the backrest bracket, and the lower backrest is rotatably connected to the upper backrest. A transfer rod and a transmission device are also arranged between the upper backrest and the base. When the backrest bracket tilts backward, the transfer rod moves relative to the backrest bracket, driving the upper backrest to rotate relative to the backrest bracket, thereby reducing the angle between the upper and lower backrests to envelop the human back, achieving the function of conforming to the back curve and improving comfort.

The technical solution of the present invention is implemented as follows:

A chair designed to enhance comfort includes an upper backrest, a lower backrest, a backrest bracket, and a base. The backrest bracket is rotatably mounted on the base, the upper backrest is rotatably mounted on the backrest bracket, and the lower backrest is rotatably connected to the upper backrest. A transfer rod and a transmission device are arranged between the upper backrest and the base, with both ends of the transfer rod rotatably connected to the upper backrest and the transmission device. When the backrest bracket tilts backward, the transfer rod moves relative to the backrest bracket under the action of the transmission device, causing the upper backrest to rotate forward relative to the backrest bracket. The lower end of the upper backrest moves backward close to the backrest bracket, reducing the angle between the upper and lower backrests.

A conventional single backrest is divided into an upper back and a lower back, namely the upper backrest and the lower backrest. The rotation of the upper backrest relative to the backrest bracket achieves the opening and closing movement between the upper and lower backrests. Moreover, as the backrest reclines backward (i.e., the backrest bracket tilts backward), the upper backrest and the lower backrest rotate synchronously, reducing the angle between them, enabling the office chair to achieve the effect of a leisure chair conforming to the back curve. This effect allows the user to feel enveloped by the upper and lower backrests when reclining backward on the chair, thereby improving comfort. The relative rotation of the upper backrest and the backrest bracket is achieved through the transmission device and the transfer rod. The transmission device is configured to drive the transfer rod to move relative to the backrest bracket when the backrest reclines backward. The transfer rod bypasses the backrest bracket and connects separately to the upper backrest. When the transfer rod moves relative to the backrest bracket, it simultaneously drives the upper backrest to move relative to the backrest bracket. The design is clever and reasonable, using a linkage mechanism to achieve the function of a leisure chair conforming to the back curve, solving the issue of using gas springs, making adjustments quick and smooth, improving effectiveness, reducing the required size, and saving costs. Moreover, the above scheme can transfer the back adjustment function of a leisure chair to an office chair.

Preferably, the lower end of the transfer rod is connected to the transmission device, the upper end of the transfer rod is rotatably connected to the lower end of the upper backrest, and the rotational connection point between the transfer rod and the upper backrest is located in front of the rotational connection point between the backrest bracket and the upper backrest. The lower end of the lower backrest is rotatably connected to the transfer rod, and the upper end of the lower backrest is rotatably connected to the lower end of the upper backrest. When the backrest bracket tilts backward, the lower end of the transfer rod moves forward, the upper end of the transfer rod moves backward, the lower end of the upper backrest and the upper end of the lower backrest move backward close to the backrest bracket, and the lower end of the lower backrest moves forward away from the backrest bracket. The rotational connection point between the transfer rod and the upper backrest is located in front of the rotational connection point between the backrest bracket and the upper backrest, with a distance between the two rotational points to allow the transfer rod to drive the upper backrest to rotate relative to the backrest bracket when moving relative to the backrest bracket. The movement of the transfer rod not only drives the upper backrest to rotate relative to the backrest bracket but also drives the lower backrest to move relative to the backrest bracket. The upper end of the lower backrest moves closer to the backrest bracket, and the lower end moves away from the backrest bracket, further achieving the bending and opening of the backrest.

Preferably, the transfer rod includes a main rod, a first connecting rod located at the upper end of the main rod, and a second connecting rod located at the lower end of the main rod. Both the first and second connecting rods protrude forward from the main rod. The first connecting rod is connected to the upper end of the upper backrest, and the second connecting rod is connected to the lower end of the lower backrest. The transfer rod is not a plain rod but approximately F-shaped. The purpose of the first connecting rod is to create a distance between the connection point of the upper backrest and the backrest bracket and the connection point of the upper backrest and the transfer rod. The purpose of the second connecting rod is to support the lower part of the lower backrest, allowing the lower backrest and the upper backrest to form a reasonable and continuous fitting surface for the human back.

Preferably, the first connecting rod is integrally formed with the main rod, the first connecting rod is inclined forward and upward relative to the main rod, the second connecting rod is rotatably connected to the main rod, and the rotational range of the second connecting rod relative to the main rod is 8-10°. The second connecting rod is rotatably connected to the main rod and the lower backrest, making the lower backrest more flexible and not obstructing the opening and closing movement between the upper backrest and the lower backrest.

Preferably, the transmission device includes a rotating member, which is rotatably arranged relative to the backrest bracket, and the transfer rod is rotatably connected to the rotating member. The rotating member is configured to drive the transfer rod to move relative to the backrest bracket when the rotating member rotates relative to the backrest bracket. The rotating member and the backrest bracket rotate, the transfer rod is connected to the rotating member, thus driving the transfer rod to move relative to the backrest bracket when the rotating member rotates. This implementation is clever and simple.

Preferably, the transmission device further includes a first link, a second link, an intermediate seat, and a swing rod. The intermediate seat is relatively fixed to the backrest bracket and rotates synchronously with the backrest bracket relative to the base. One end of the first link is rotatably connected to the base, the upper end of the second link is rotatably connected to the other end of the first link, the lower end of the second link is rotatably connected to the intermediate seat, and the swing rod is rotatably connected to the upper end of the second link. The rotating member is rotatably arranged on the intermediate seat, with the front end of the rotating member rotatably connected to the swing rod, and the rear end of the rotating member rotatably connected to the transfer rod. When the backrest bracket tilts backward, the backrest bracket rotates downward and backward relative to the base, and the intermediate seat fixed to the backrest bracket also rotates synchronously, driving the second link to move downward and forward. The second link drives the first link to rotate downward and backward relative to the base, simultaneously pulling the swing rod to move forward and downward. The swing rod pulls the rotating member to rotate forward relative to the intermediate seat, thereby driving the transfer rod to move relative to the intermediate seat and the backrest bracket. The specific structure and connection method of the transmission device: the base, the middle seat, the first link and the second link constitute a four-bar linkage, and the base is configured as a main support to remain relatively stationary; the middle seat and the first link are relatively When the base rotates, the second link remains roughly vertical; the backward tilting of the backrest bracket when the chair is tilted back drives the transmission device to move, so that the chair tilts backward and the upper and lower backrests are bent and wrapped simultaneously.

Preferably, a connecting seat extends backward from the middle seat, and the connecting seat is hollow and formed with a receiving groove. The rotating member is located in the receiving groove and is rotationally connected to the connecting seat through a rotating shaft. The connecting seat is open in the up and down direction, the rotating part is arranged in the receiving groove of the connecting seat, the lower end of the transfer rod is located in the receiving groove and is rotationally connected with the rotating part, the connecting seat extends backward beyond the middle seat body, so that the transfer rod has room for movement, and the transfer rod will not interfere with the middle seat when moving.

Preferably, the shape of the rotating member is triangular. Its three corners are exactly three rotation connection points.

Preferably, the backrest bracket is an L-shaped structure. The backrest bracket includes a transverse section and a vertical section. The transverse section is located on the left and right sides of the rear of the base. The front end of the transverse section is rotationally connected to the rear end of the base; the left and right sections at the upper end of the middle position of the transverse section are support seats are fixed on both sides, and the support seats are connected through connecting beams, and the connecting beams are pressed above the middle seat, so that when the backrest bracket rotates, the transverse sections can rotate synchronously through the connecting beams pressing down on the middle seat. The connecting beam not only connects the two transverse sections into a whole to make them move left and right synchronously, but also serves as a downward driving member of the middle seat. When the middle seat is reset in the reverse direction, it gives the connecting beam an upward lifting force to restore the backrest bracket to original position.

Preferably, the base includes a bottom shell and a base seat member, the bottom shell is fixedly connected to the base seat member, the middle seat and the backrest bracket are rotatably connected to the bottom shell, and the first connecting rod is rotatably connected to the base seat member. The bottom shell is covered outside the base seat member, and the backrest bracket can be connected outside the bottom shell. The first connecting rod is connected to the base seat member inside the bottom shell. The two can be rotated and connected with the base without conflict. It is compact in the front and rear directions and can move left and right at the same time. Avoiding each other in the direction, and the space arrangement is more reasonable.

Preferably, the lower backrest has a frame structure, and the upper backrest includes an upper backrest support body and an upper backrest frame. The upper backrest support body is fixedly connected to the upper backrest frame; the upper backrest support body has a frame structure, and the lower end of the upper backrest frame is rotatably connected to the upper end of the backrest bracket.

Preferably, the upper backrest frame includes a third connecting rod extending forward, and the third connecting rod is fixedly connected to the upper backrest support body and rotationally connected to the upper end of the transfer rod. The transfer rod and the backrest bracket are both rotationally connected to the lower end of the upper backrest. The connection point between the transfer rod and the upper backrest and the connection point between the backrest bracket and the upper backrest are separated through the third connecting rod, thereby realizing that the upper backrest can rotate relative to the backrest bracket under the action of the transfer rod.

The design starting point, concept and beneficial effects of the present invention adopting the above technical solution are:

The traditional single chair back is now divided into an upper back and a lower back, that is, an upper backrest and a lower backrest, and the opening and closing movement between the upper backrest and the lower backrest is realized by the rotation of the upper backrest relative to the backrest bracket, and, when the chair back is tilted backward (that is, when the back support is tilted backward), the upper backrest and the lower backrest rotate relative to each other simultaneously, reducing the angle between the two, so that the office chair can bend with the back like a leisure chair. The wrapping effect allows the user to feel the wrapping feeling given by the upper backrest and the lower backrest when lying back on the chair, thereby improving comfort. The relative rotation of the upper backrest and the backrest bracket is achieved through a transmission device and a transfer rod. The transmission device is configured to drive the transfer rod to move relative to the backrest bracket when the chair back is tilted backward, and the transfer rod bypasses the backrest bracket. It is independently connected to the upper backrest. When the transfer rod moves relative to the backrest bracket, it can synchronously drive the upper backrest to move relative to the backrest bracket. The design is ingenious and the structure is reasonable. The function of bending and wrapping the leisure chair with the back is realized through the link mechanism, solves the problem of using air rods, makes the adjustment fast and smooth, has better effects, reduces the required volume, and saves costs. Moreover, through the above solution, the back adjustment function of the leisure chair can be transplanted into the office chair.

Figure 1:
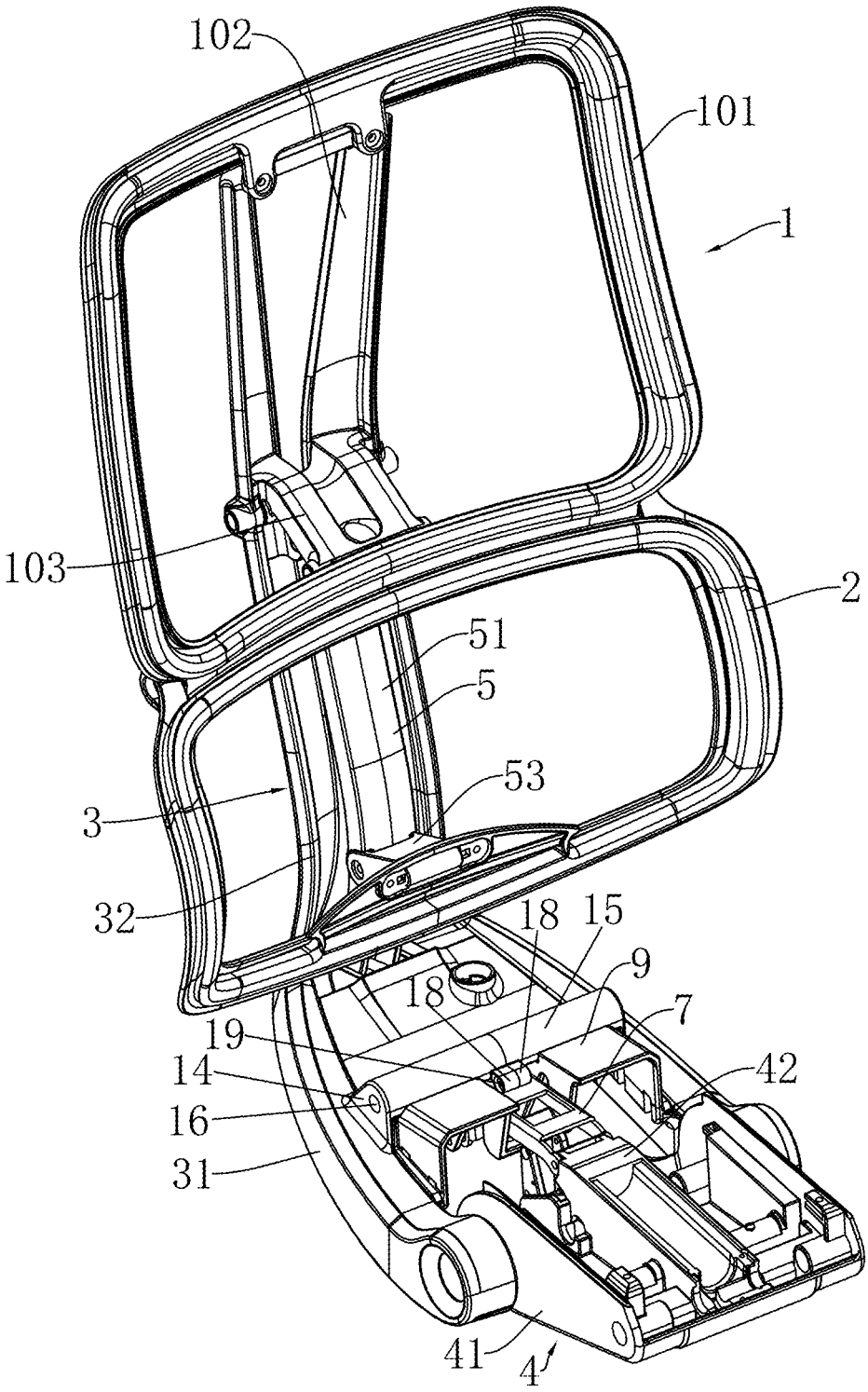
FIG. 1 is a first schematic diagram of the three-dimensional structure of the chair when the back of the chair is not tilted back in an embodiment of the present invention.

The reference numbers are: upper backrest 1; upper backrest support body 101; upper backrest frame 102; third connecting rod 103; lower backrest 2; backrest bracket 3; horizontal section 31; vertical section 32; base 4; bottom shell 41; base seat member 42; transfer rod 5; main rod 51; first connecting rod 52; second connecting rod 53; rotating member 6; first link 7; second link 8; intermediate seat 9; connecting seat 91; accommodation groove 92; rotating shaft 93; swing rod 10; socket 11; chair seat member 12; support rod 13; support base 14; shaft hole 16; shaft 17; connecting ear 18; threaded hole 19; pivot 20.

DETAILED DESCRIPTION OF THE INVENTION

To better understand the objects, features, and advantages of the present invention, the invention will be further described in detail below in conjunction with the accompanying drawings and specific embodiments. It should be noted that, without conflict, the embodiments and features of the embodiments in this application can be combined with each other.

Many specific details are set forth in the following description to provide a thorough understanding of the present invention. However, the present invention can also be implemented in other ways different from those described herein, and therefore, the protection scope of the present invention is not limited to the specific embodiments disclosed below.

In the description of the present invention, the terms "first," "second," "third," etc., are used solely for descriptive purposes and are not to be construed as indicating or implying relative importance.

Figure 2:
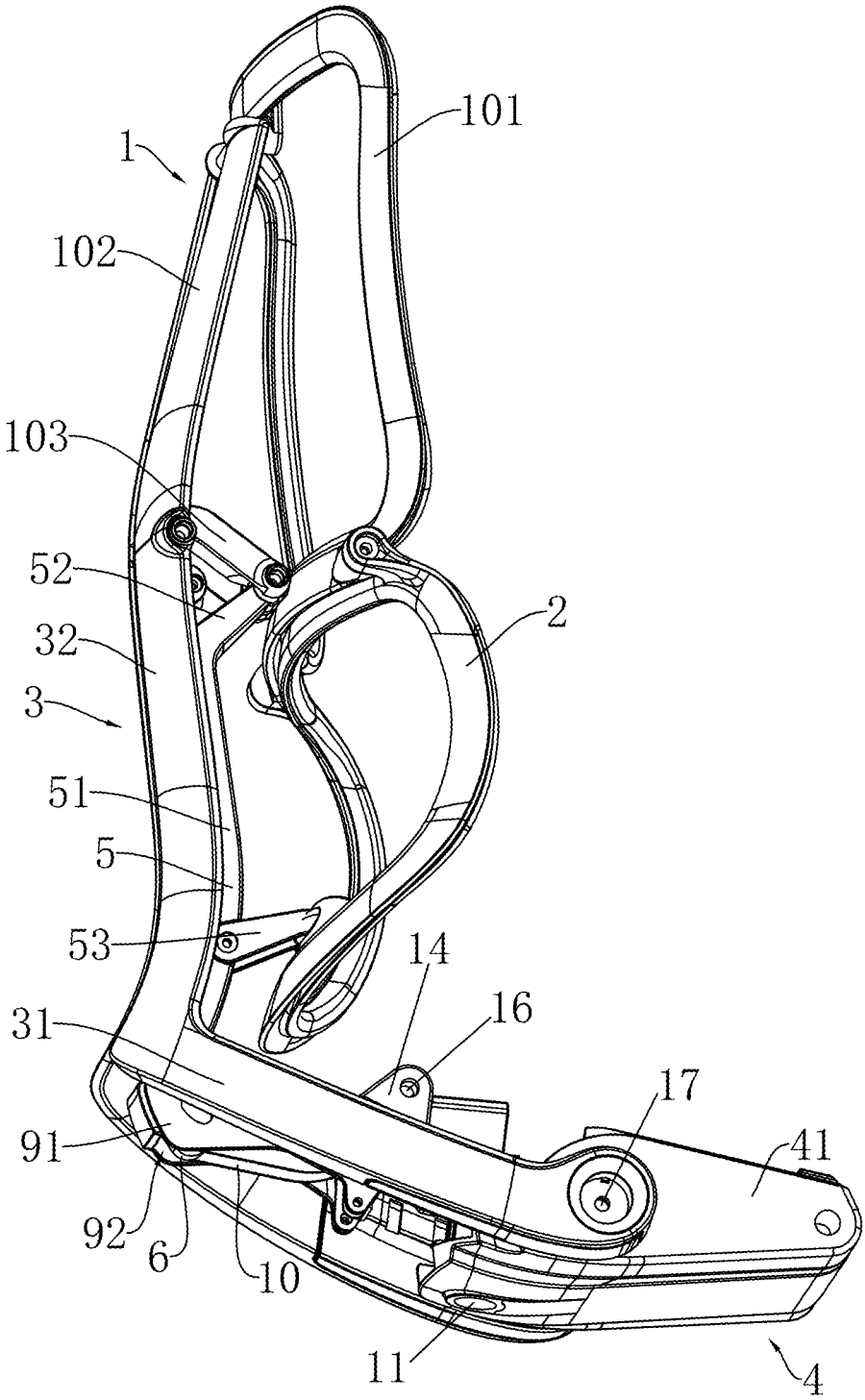
FIG. 2 is a second schematic diagram of the three-dimensional structure of the chair when the back of the chair is not tilted back in the embodiment of the present invention.
Figure 3:
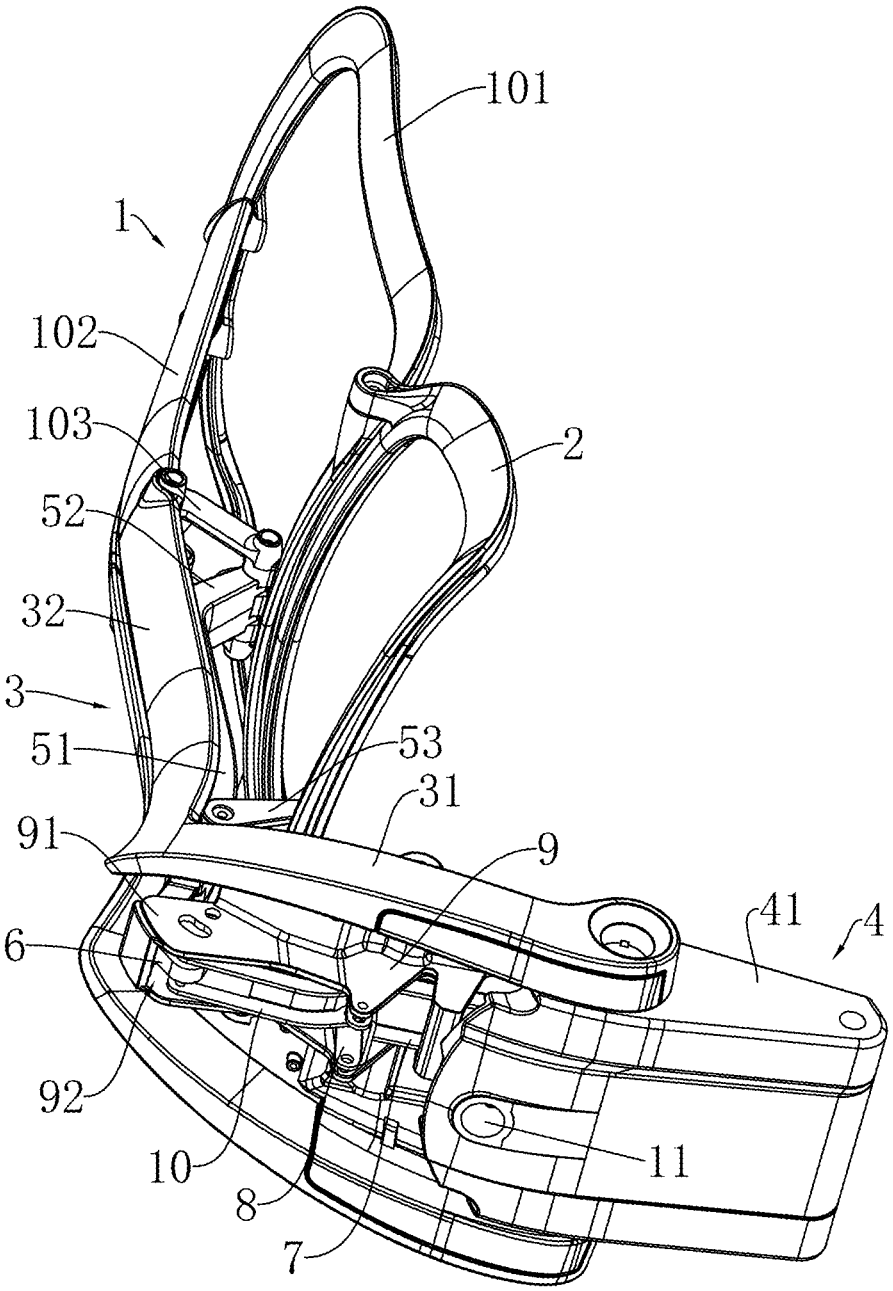
FIG. 3 is a third schematic diagram of the three-dimensional structure of the chair when the back of the chair is not tilted back in the embodiment of the present invention.
Figure 7:
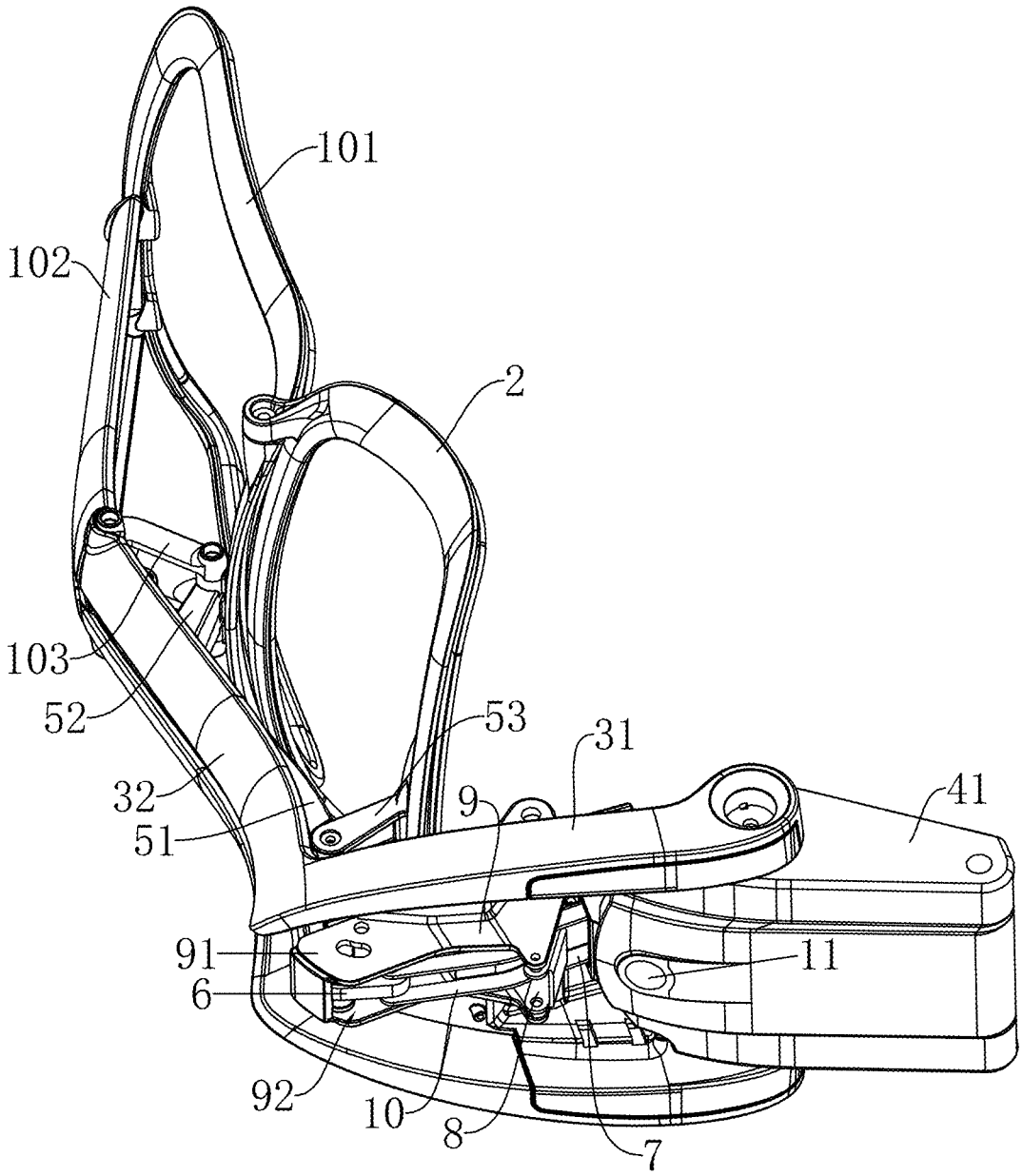
FIG. 7 is a third schematic diagram of the three-dimensional structure of the chair when the back of the chair is tilted back in the embodiment of the present invention.
Figure 9:
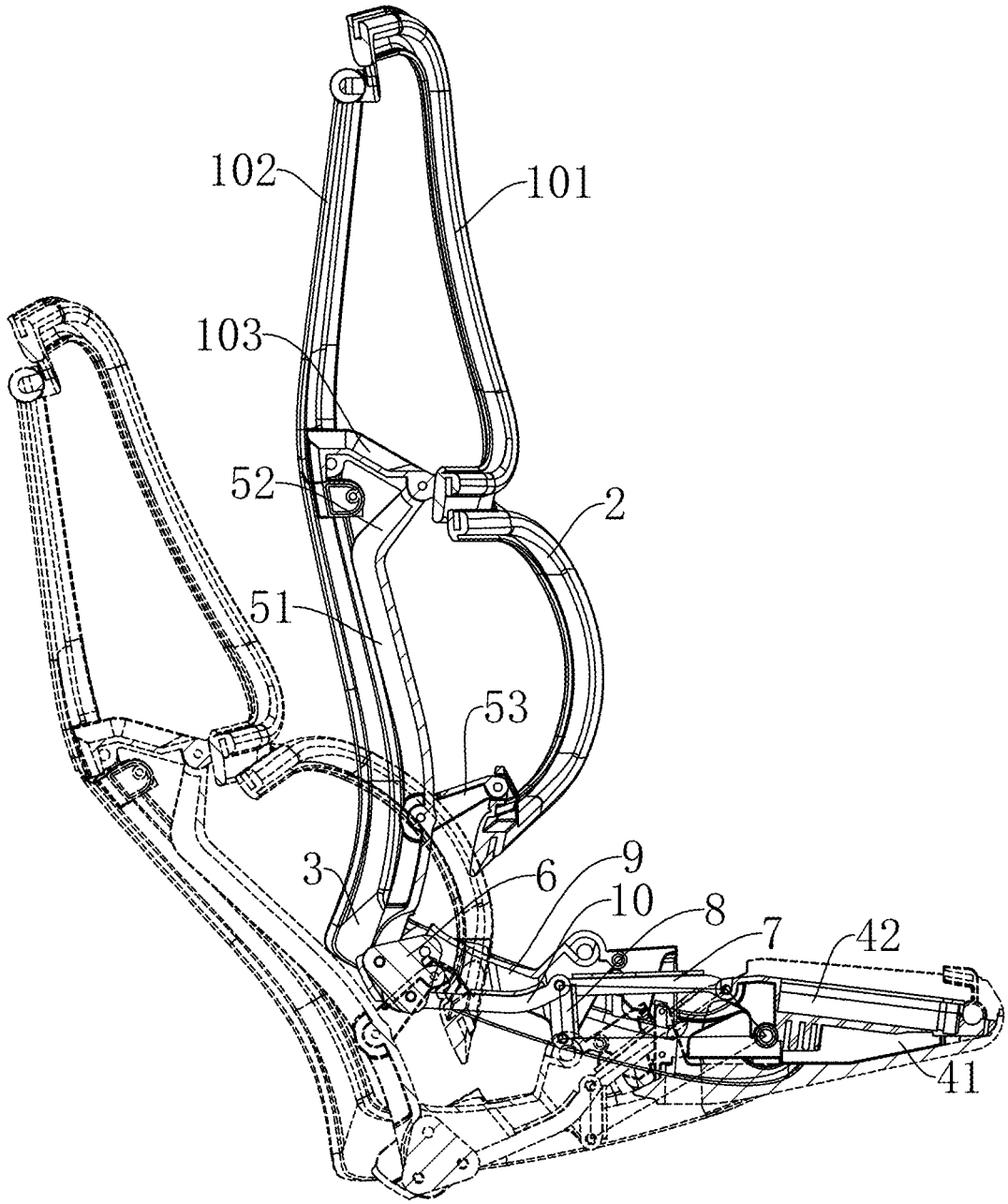
FIG. 9 is a schematic diagram of the movement of each component when the chair is bent and wrapped with the back in an embodiment of the present invention.

The specific implementation of the present invention is as follows:

As shown in FIG. 9, the present invention provides a chair designed to enhance comfort, which includes an upper backrest 1, a lower backrest 2, a backrest bracket 3, and a base 4. The base 4 serves as the main support of the chair. As shown in FIGS. 2, 3, and 7, the bottom surface of the base 4 is equipped with a socket 11 for inserting a gas cylinder (not shown). The backrest bracket 3 is rotatably mounted on the base 4, the upper backrest 1 is rotatably mounted on the backrest bracket 3, and the lower backrest 2 is rotatably connected to the upper backrest 1. Additionally, a transfer rod 5 and a transmission device are installed between the upper backrest 1 and the base 4. Both ends of the transfer rod 5 are rotatably connected to the upper backrest 1 and the transmission device, respectively. When the backrest bracket 3 tilts backward, the transfer rod 5 moves relative to the backrest bracket 3 under the action of the transmission device. This causes the upper backrest 1 to rotate forward relative to the backrest bracket 3 due to the action of the transfer rod 5. As a result, the lower end of the upper backrest 1 moves backward toward the backrest bracket 3, reducing the angle between the upper backrest 1 and the lower backrest 2, thereby wrapping around the user's back.

The traditional single chair back is now divided into an upper back and a lower back, that is, the upper backrest 1 and the lower backrest 2, and the rotation between the upper backrest 1 and the lower backrest 2 is realized by the rotation of the upper backrest 1 relative to the backrest bracket 3 opening and closing movement, and at the same time as the chair back falls backward (that is, when the back support 3 falls backward), the upper backrest 1 and the lower backrest 2 rotate relative to each other simultaneously, reducing the angle between them. The office chair achieves the effect of a leisure chair bending and wrapping with the back. This effect allows the user to feel the wrapping feeling given by the upper backrest 1 and the lower backrest 2 when lying back on the chair, thereby improving comfort. The relative rotation of the upper backrest 1 and the backrest bracket 3 is realized through the transmission device and the transfer rod 5. The transmission device is configured to drive the transfer rod 5 to move relative to the backrest bracket 3 when the chair back is tilted backward, and the transfer rod 5 bypasses the backrest bracket 3 and is connected to the upper backrest 1 alone. When the transfer rod 5 moves relative to the backrest bracket 3, it can synchronously drive the upper backrest 1 to move relative to the backrest bracket 3. This ingenious design and reasonable structure achieve the function of a recliner chair's bending and wrapping backrest through a linkage mechanism, solving the problem of using a gas cylinder, making adjustments quicker and smoother, improving the effect, reducing the required volume, saving costs, and allowing the recliner chair's back adjustment function to be applied to an office chair.

The logic for achieving the bending and wrapping backrest of the chair is as follows: the backrest is first divided into upper and lower sections, i.e., the upper backrest and the lower backrest, giving them the ability to open and close. Further, the opening and closing ability is realized by the transfer rod 5 driving the upper backrest 1, so the transfer rod 5 must move relative to the backrest bracket 3. Additionally, the linkage component of the transmission device can drive the transfer rod 5 to move relative to the backrest bracket 3.

More specifically, as shown in FIGS. 1-3 and 5-7, the traditional backrest is divided into an upper backrest 1 and a lower backrest 2. The upper backrest 1 includes an upper backrest support body 101 and an upper backrest frame 102. The upper backrest support body 101 can be either a frame structure or a plate structure. The upper end of the upper backrest support body 101 is inserted into and fixed to the upper end of the upper backrest frame 102 with screws. Similarly, the lower end of the upper backrest support body 101 is inserted into and fixed to the lower end of the upper backrest frame 102. Therefore, they are fixedly connected together. Furthermore, the upper backrest frame 102 includes a third connecting rod 103 that extends forward. The third connecting rod 103 is located at the lower end of the upper backrest frame 102 and slopes forward and downward, connecting its front end to the upper backrest support body 101 and its rear end to the lower end of the upper backrest frame 102. The backrest bracket 3 is rotatably connected to the lower end of the upper backrest frame 102. The third connecting rod 103 increases the distance between the lower end of the upper backrest support body 101 and the backrest bracket 3. The lower backrest 2 can also be either a frame structure or a plate structure. The upper end of the lower backrest 2 is rotatably connected to the lower end of the upper backrest support body 101, allowing them to rotate relative to each other around a horizontal axis to achieve the opening and closing movement.

The opening and closing movement of the upper backrest 1 and the lower backrest 2 is driven by the transfer rod 5: the lower end of the transfer rod 5 is connected to the transmission device, while the upper end is rotatably connected to the lower end of the upper backrest 1. The rotational connection point of the transfer rod 5 and the upper backrest 1 is located in front of the rotational connection point of the backrest bracket 3 and the upper backrest 1. Specifically, the lower end of the upper backrest support body 101 is inserted into the front end of the third connecting rod 103. At the same time, the upper end of the transfer rod 5 is also inserted into this position and rotatably connected to the upper backrest 1 via a rotating shaft. The third connecting rod 103 has a notch around the upper end of the transfer rod 5 to provide space for its rotation. The third connecting rod 103 increases the distance between the lower end of the upper backrest support body 101 and the backrest bracket 3, creating a gap between the two rotational connection points. The transfer rod 5 and the backrest bracket 3 are both rotatably connected to the lower end of the upper backrest 1. The third connecting rod 103 separates the connection points of the transfer rod 5 and the upper backrest 1 from the connection points of the backrest bracket 3 and the upper backrest 1. This allows the upper backrest 1 to rotate relative to the backrest bracket 3 under the action of the transfer rod 5, i.e., the upper backrest 1 and the backrest bracket 3 can rotate relative to each other around the left and right directions axis.

The lower end of the lower backrest 2 is rotatably connected to the transfer rod 5. When the backrest bracket 3 tilts backward, the lower end of the transfer rod 5 moves forward, and its upper end moves backward. The lower end of the upper backrest 1 and the upper end of the lower backrest 2 move backward toward the backrest bracket 3, while the lower end of the lower backrest 2 moves forward away from the backrest bracket 3. The rotational connection point of the transfer rod 5 and the upper backrest 1 is located in front of the rotational connection point of the backrest bracket 3 and the upper backrest 1. The distance between these two points allows the transfer rod 5 to drive the upper backrest 1 to rotate relative to the backrest bracket 3. If the two connection points were at the same location, the transfer rod 5 could not drive the upper backrest 1 to rotate relative to the backrest bracket 3. The movement of the transfer rod 5 not only drives the upper backrest 1 to rotate relative to the backrest bracket 3 but also drives the lower backrest 2 to move relative to the backrest bracket 3. The upper end of the lower backrest 2 moves closer to the backrest bracket 3, while the lower end moves further away from the backrest bracket 3, achieving a further bending and opening of the backrest.

Figure 4:
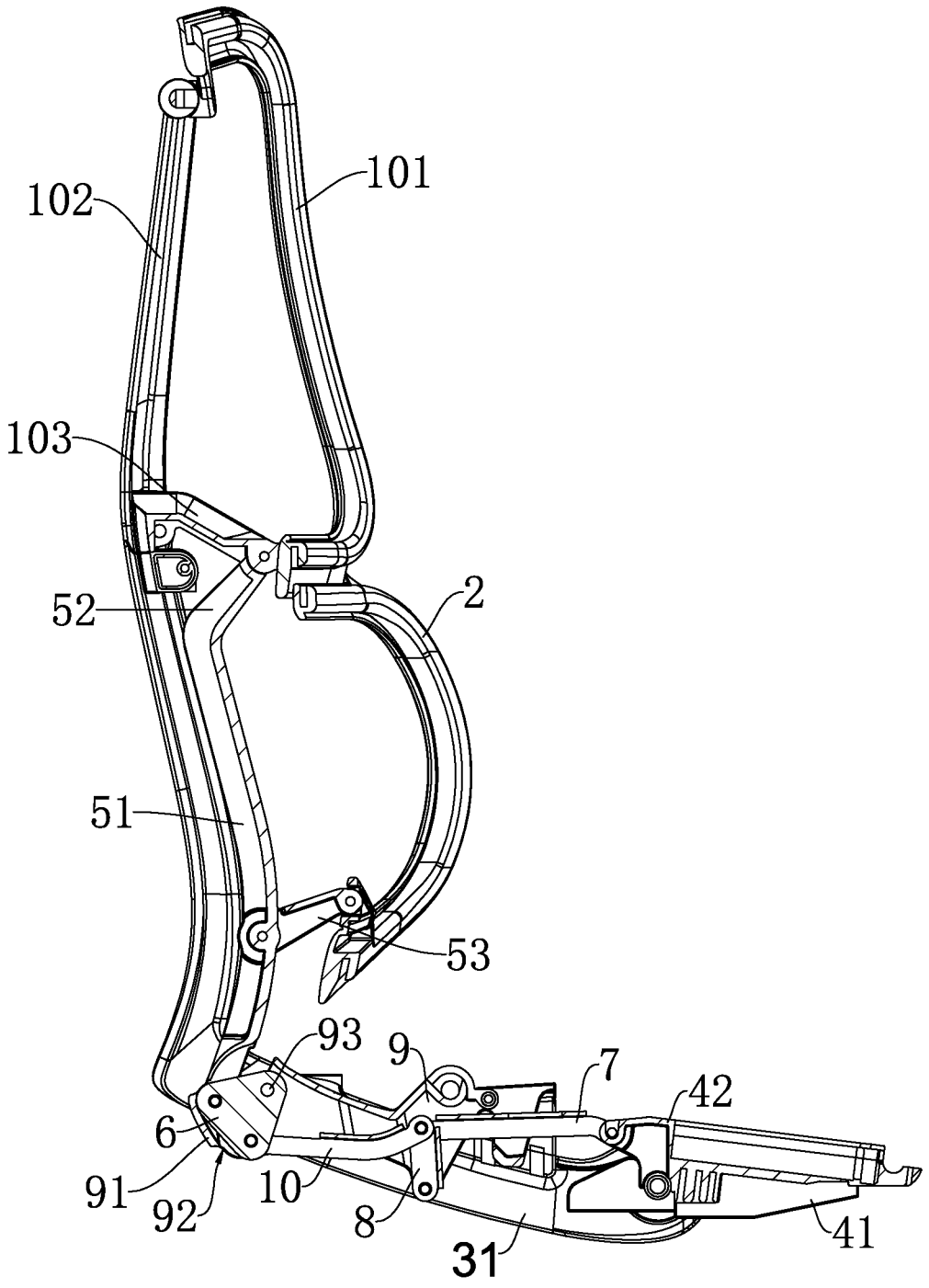
FIG. 4 is a cross-sectional view of the chair when the back of the chair is not tilted back in an embodiment of the present invention.
Figure 5:
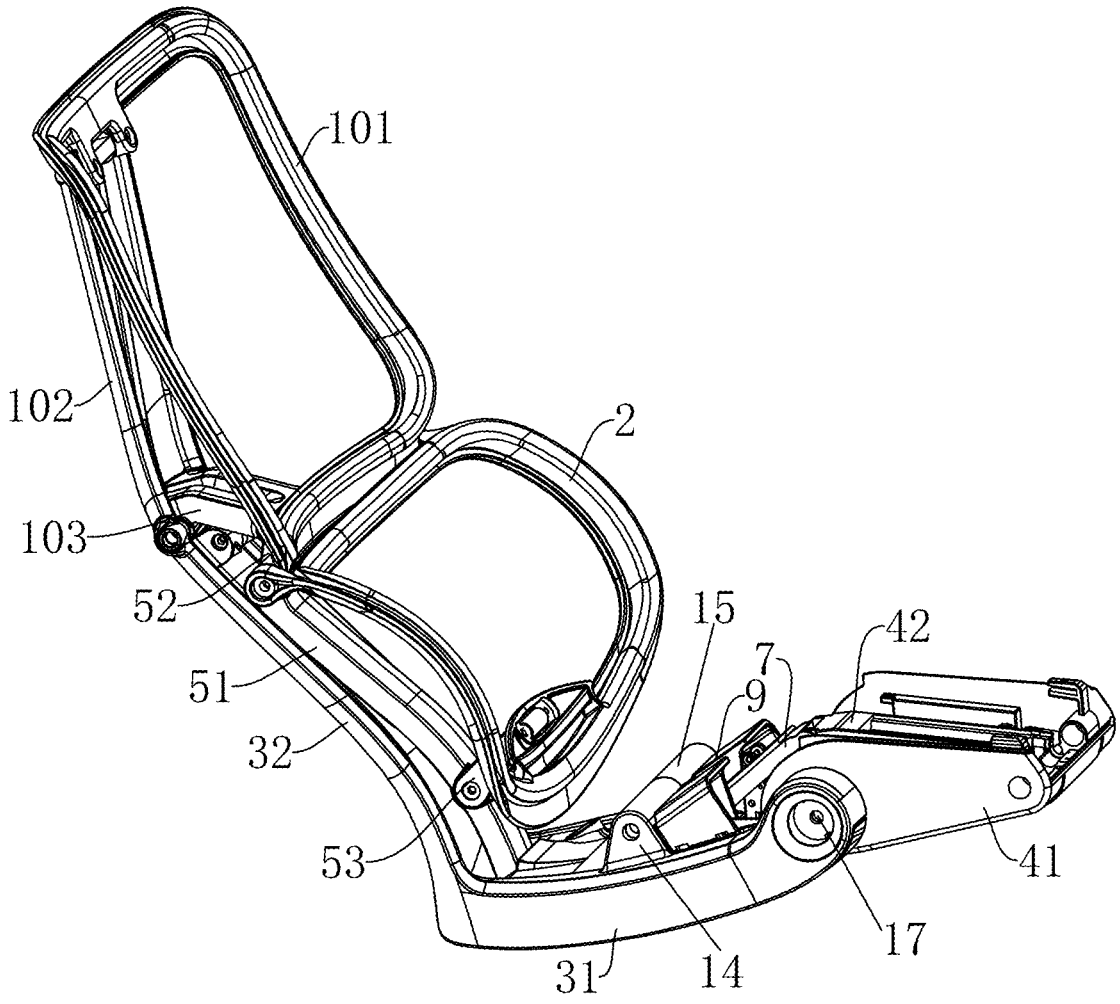
FIG. 5 is a first schematic diagram of the three-dimensional structure of the chair when the back of the chair is tilted back in the embodiment of the present invention.
Figure 6:
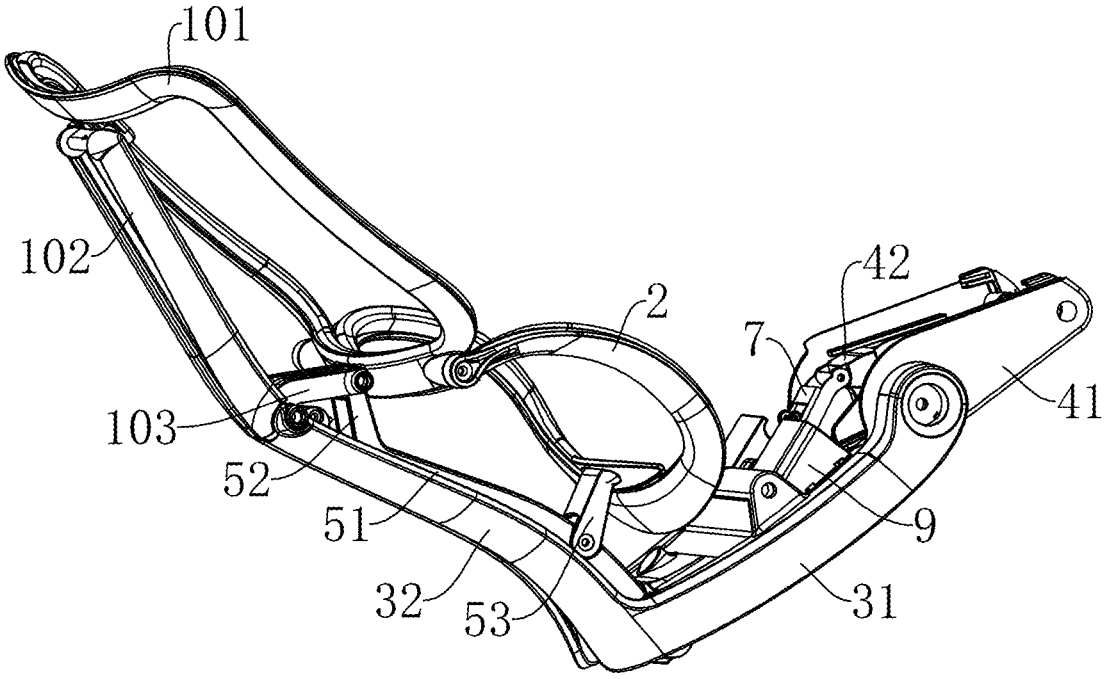
FIG. 6 is a second schematic diagram of the three-dimensional structure of the chair when the back of the chair is tilted back in an embodiment of the present invention.
Figure 8:
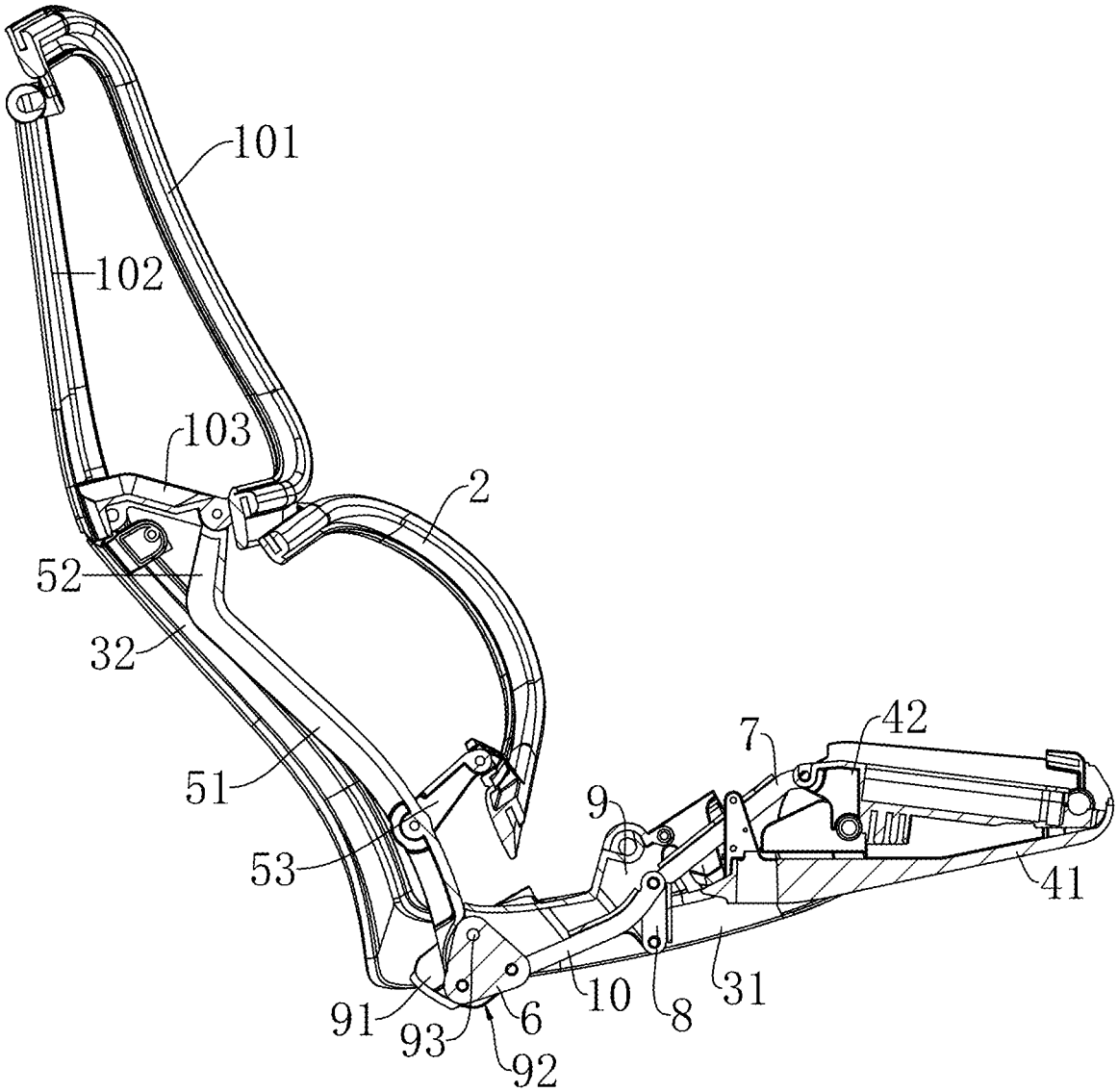
FIG. 8 is a cross-sectional view of the chair when the back of the chair is tilted back in an embodiment of the present invention.

Further, as shown in FIGS. 4 and 8, the transfer rod 5 includes a main rod 51, a first connecting rod 52 at the upper end of the main rod 51, and a second connecting rod 53 at the lower end of the main rod 51. Both the first connecting rod 52 and the second connecting rod 53 extend forward from the main rod 51. The first connecting rod 52 is connected to the upper end of the upper backrest 1, while the second connecting rod 53 is connected to the lower end of the lower backrest 2. The transfer rod 5 is not a simple rod but is approximately F-shaped. The purpose of the first connecting rod 52 is to be rotatably connected to the front end of the third connecting rod 103. Together, they create a gap between the connection point of the upper backrest 1 and the backrest bracket 3 and the connection point of the upper backrest 1 and the transfer rod 5. The purpose of the second connecting rod 53 is to support the lower part of the lower backrest 2, creating a reasonable continuous contact surface between the lower backrest 2 and the upper backrest 1 for the user's back to rest against. The first connecting rod 52 is integrally formed with the main rod 51 and slopes forward and upward relative to the main rod 51. The second connecting rod 53 is rotatably connected to the main rod 51, with a rotation range of 8-10 degrees. The second connecting rod 53 is also rotatably connected to the lower backrest 2, ensuring that the lower backrest 2 and the main rod 51 are flexible and do not hinder the opening and closing movement between the upper backrest 1 and the lower backrest 2.

There are many options for the transmission device, as long as it can drive the transfer rod 5 to rotate relative to the backrest bracket 3. In this embodiment, since integrating the reclining and wrapping function into an office chair is a major challenge, a simple yet ingenious structure is preferred: the transmission device includes a rotating member 6. The rotating member 6 is set to rotate relative to the backrest bracket 3. The transfer rod 5 is rotationally connected to the rotating member 6, which is configured to drive the transfer rod 5 to move relative to the backrest bracket 3 when the rotating member 6 rotates relative to the backrest bracket 3.

More specifically, as shown in FIGS. 1-9, the transmission device includes a first connecting rod 7, a second connecting rod 8, an intermediate seat 9, a swing rod 10, and the rotating member 6. Both the intermediate seat 9 and the backrest bracket 3 are rotatably connected to the base 4. Specifically, the base 4 includes a bottom shell 41 and a base seat member 42. The bottom shell 41 is located on both the left and right sides of the base seat member 42 and is fixedly connected to it, forming an integral structure. The backrest bracket 3 has an L-shaped structure, comprising an integrally formed horizontal section 31 and vertical sections 32, with one vertical section 32 on each side. The horizontal section 31 extends forward from the lower ends of the vertical sections 32. Alternatively, the vertical sections 32 can be a single column, with the lower end of the column bifurcating forward symmetrically to form the horizontal section 31. The front end of the horizontal section 31 is rotatably connected to the bottom shell 41 of the base 4 through a shaft 17. A support seat 14 is fixed on the upper surface of the horizontal section 31's middle part, with a shaft hole 16 on the support seat 14. A connecting beam 15 connects the two support seats 14 on the left and right sides. The connecting beam 15 consists of two sections, with connecting ears 18 extending forward at the junction of the two sections. The connecting ears 18 have threaded holes, and when aligned, screws pass through the ears to secure them, thereby connecting the two horizontal sections 31 into an integral structure. This allows the left and right backrest brackets to move synchronously.

The intermediate seat 9 can be considered the rear plate of the base 4. Its rotation can directly or indirectly drive the elastic elements inside the base 4 to deform, thereby converting into the restoring force of the base 4. This function will be detailed in subsequent paragraphs. In this embodiment, the intermediate seat 9 is a housing-type structure, with part of it located beneath the connecting beam 15, meaning it is pressed by the connecting beam 15. Thus, when the backrest bracket 3 rotates downward around the shaft 17, it drives the intermediate seat 9 to rotate downward through the connecting beam 15.

One end of the first connecting rod 7 is rotatably connected to the middle rear end of the base seat member 42 of the base 4, while the upper end of the second connecting rod 8 is rotatably connected to the other end of the first connecting rod 7. The lower end of the second connecting rod 8 is rotatably connected to the intermediate seat 9. The base 4, the intermediate seat 9, the first connecting rod 7, and the second connecting rod 8 form a four-link mechanism, with the base 4 configured as the main support, maintaining relative stability. When the intermediate seat 9 and the first connecting rod 7 rotate relative to the base 4, the second connecting rod 8 remains approximately vertical. The swing rod 10 is rotatably connected to the upper end of the second connecting rod 8. The rotating member 6 is rotatably installed on the intermediate seat 9, with its front end rotatably connected to the swing rod 10 and its rear end rotatably connected to the transfer rod 5. When the chair back reclines, the backrest bracket 3 rotates downward and backward relative to the base 4, driving the intermediate seat 9 to rotate synchronously via the connecting beam 15. This, in turn, drives the second connecting rod 8 to move downward and forward, which then drives the first connecting rod 7 to rotate downward and backward relative to the base 4, simultaneously pulling the swing rod 10 to move forward and downward. The swing rod 10 pulls the rotating member 6 to rotate forward relative to the intermediate seat 9, thereby driving the transfer rod 5 to move relative to the intermediate seat 9 and the backrest bracket 3. The movement of the various connecting rods in the transmission device is driven by the reclining motion of the backrest bracket 3. When a person reclines in the chair, the movement of the backrest bracket 3 leads to the linkage of the various connecting rods in the transmission device, achieving synchronized recline of the chair back and the bending and wrapping of the upper and lower backrest parts 2, resulting in smooth movement and enhanced comfort.

In the four-link mechanism formed by the base 4, the intermediate seat 9, the first connecting rod 7, and the second connecting rod 8, the configuration of the connection points and the distances between them ensures that the second connecting rod 8 remains approximately vertical during movement, thereby enabling it to pull the swing rod 10 effectively.

The rotating member 6 is triangular, with its three corners serving as three rotational connection points. The upper end of the rotating member 6 is rotatably connected to the intermediate seat 9, the front end is rotatably connected to the rear end of the swing rod 10, and the rear end is rotatably connected to the lower end of the transfer rod 5. The intermediate seat 9 extends rearward to form a connecting seat 91, which is hollow with an accommodating slot 92. The rotating member 6 is positioned in the accommodating slot 92 and is rotatably connected to the connecting seat 91 via a rotating shaft 93. The connecting seat 91 is open in the vertical direction, with the rotating member 6 placed within its accommodating slot 92. The lower end of the transfer rod 5 is also positioned within the accommodating slot 92 and is rotatably connected to the rotating member 6. The connecting seat 91 extends rearward beyond the body of the intermediate seat 9, providing movement space for the transfer rod 5, ensuring it does not interfere with the intermediate seat 9 during motion.

The bottom shell 41 encases the base seat member 42. The backrest bracket 3 can be connected outside the bottom shell 41. The first connecting rod 7 is connected to the base seat member 42 inside the bottom shell 41, with both capable of rotatably connecting to the base 4 without conflict. The front-to-back direction remains compact while the left-to-right direction avoids mutual interference, resulting in a more reasonable spatial arrangement.

Figure 10:
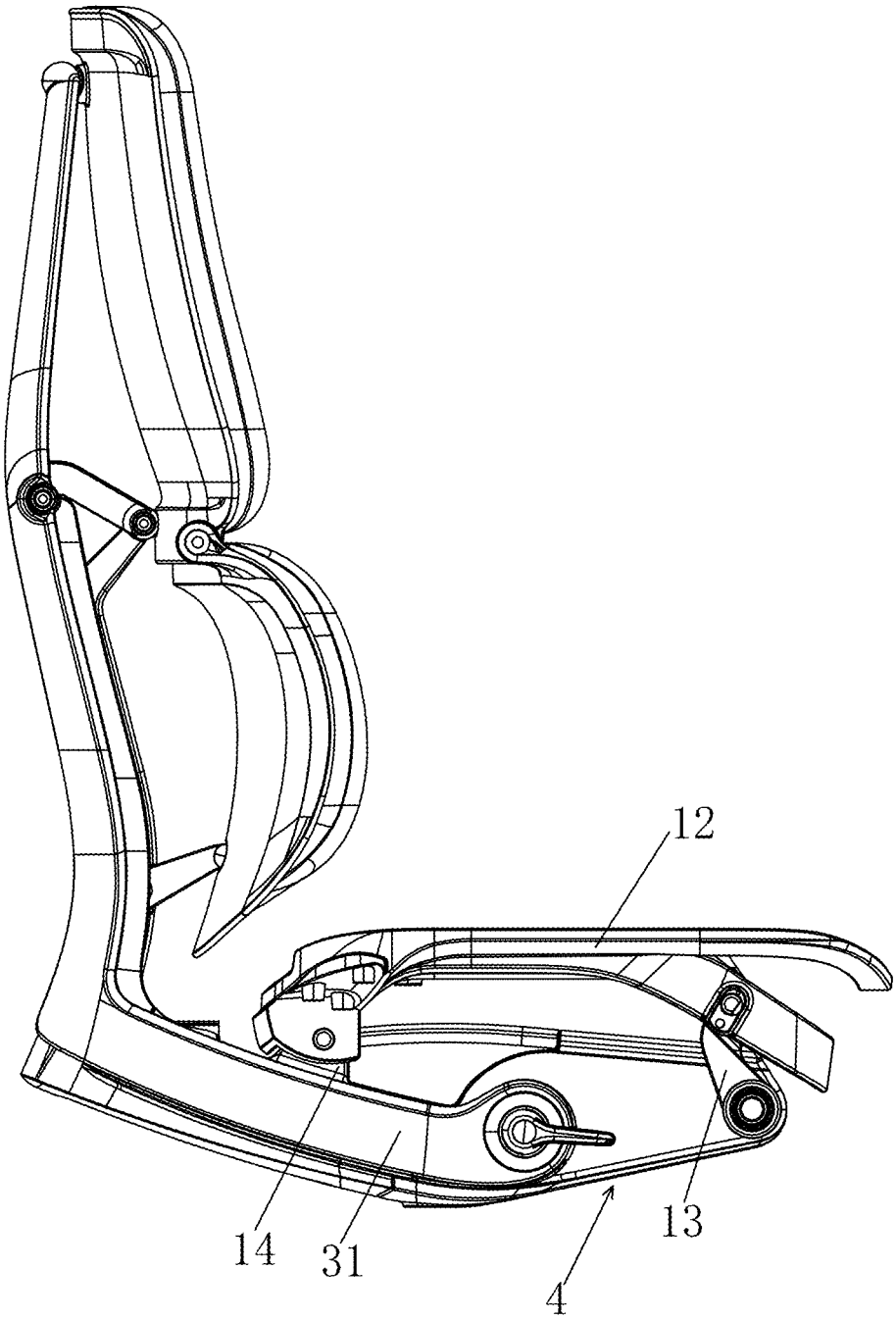
FIG. 10 is a side view of the chair in this embodiment when it is not tilted back.
Figure 11:
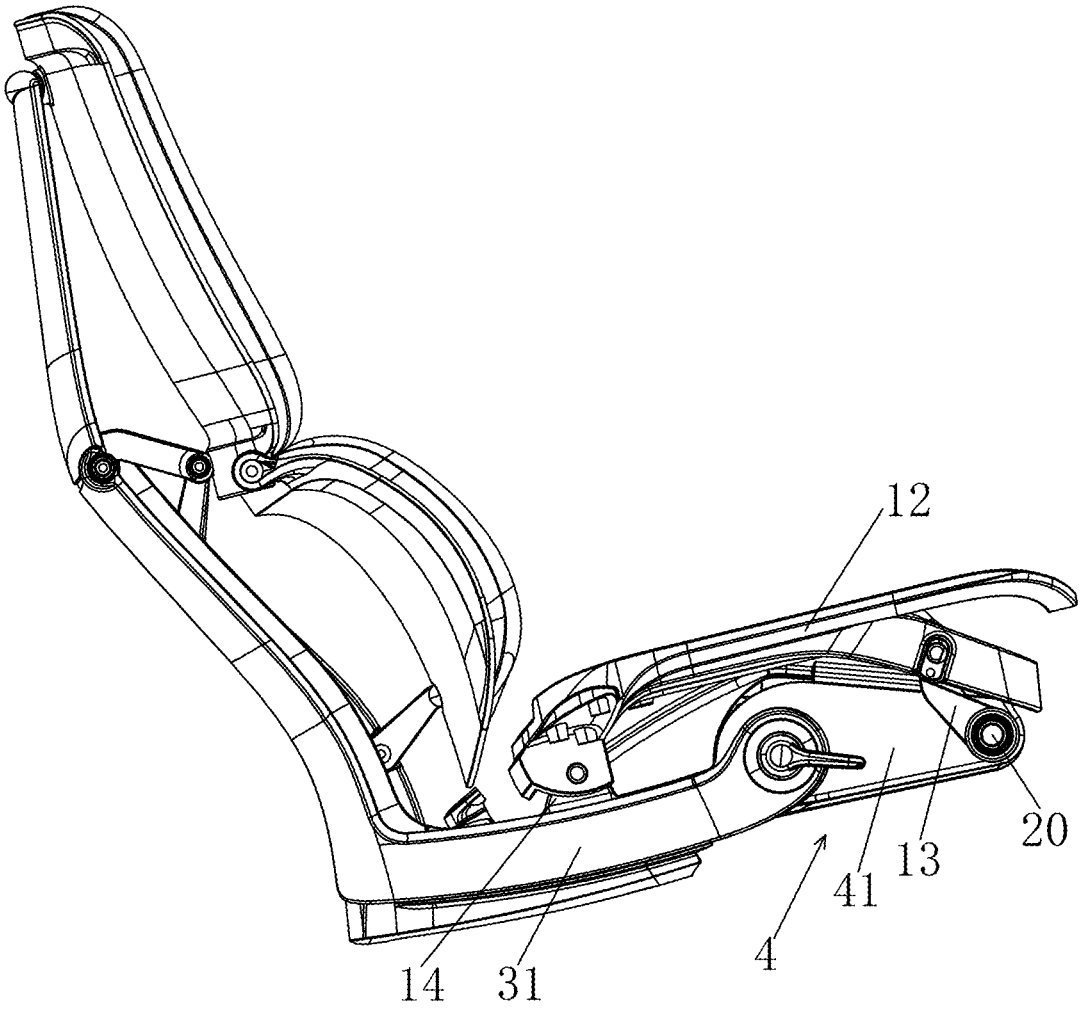
FIG. 11 is a side view of the chair in this embodiment when it is tilted back.

In practical application, as shown in FIGS. 10 and 11, the upper back support 101 is covered with foam or mesh, and the lower backrest 2 is also covered with foam or mesh. The chair further includes a chair seat member 12, with a support rod 13 positioned between the front end of the chair seat member 12 and the front end of the base 4. The upper end of the support rod 13 is hinged to the front end of the chair seat member 12, while the lower end is rotatably connected to the front end of the bottom shell 41 of the base 4 via a pivot 20. The rear end of the chair seat member 12 is rotatably connected to the shaft hole 16 of the support seat 14. There are no strict limitations on the structure of the base, as long as it can generate a reclining restoring force. For instance, in this embodiment, a base similar to that disclosed in the applicant's earlier patent application number CN202211520033.X, which uses an elastic plate such as a spring steel plate as the source of the restoring force, can be used. In the base 4 of this embodiment, a similar principle can be applied. For example, an elastic plate (not shown) can be arranged on each side of the base, with the front end of each plate fixed in the front part of the base. The middle part of each plate rests on a fulcrum, and the rear end extends into the intermediate seat 9. When the backrest bracket 3 and the intermediate seat 9 rotate downward together, the elastic plates deform, generating a restoring force.

The invention claimed is:

1. A chair with improved comfort, characterized by comprising:

an upper backrest, a lower backrest, a backrest bracket, and a base, wherein the backrest bracket is rotatably mounted on the base, the upper backrest is rotatably mounted on the backrest bracket, and the lower backrest is rotatably connected to the upper backrest; a transfer rod and a transmission device are also provided between the upper backrest and the base, with two ends of the transfer rod rotatably connected to the upper backrest and the transmission device, respectively;

wherein when the backrest bracket tilts backward, under the action of the transmission device, the transfer rod moves relative to the backrest bracket, causing the upper backrest to rotate forward relative to the backrest bracket due to the action of the transfer rod, a lower end of the upper backrest approaches the backrest bracket backward, and an angle between the upper backrest and the lower backrest decreases.

2. The chair with improved comfort according to claim 1, wherein:

a lower end of the transfer rod is connected to the transmission device, an upper end of the transfer rod is rotatably connected to the lower end of the upper backrest, with a rotational connection point of the transfer rod and the upper backrest being located in front of the rotational connection point between the backrest bracket and the upper backrest, the lower end of the lower backrest is rotatably connected to the transfer rod, and an upper end of the lower backrest is rotatably connected to the lower end of the upper backrest;

wherein when the backrest bracket tilts backward, the lower end of the transfer rod moves forward, the upper end of the transfer rod moves backward, the lower end of the upper backrest and the upper end of the lower backrest move backward approaching the backrest bracket, and the lower end of the lower backrest moves forward away from the backrest bracket.

3. The chair with improved comfort according to claim 2, wherein:

the transfer rod comprises a main rod, a first connecting rod located at an upper end of the main rod, and a second connecting rod located at a lower end of the main rod, wherein both the first connecting rod and the second connecting rod protrude forward from the main rod;

wherein the first connecting rod is connected to the upper end of the upper backrest, and the second connecting rod is connected to the lower end of the lower backrest.

4. The chair with improved comfort according to claim 3, wherein:

the first connecting rod is integrally formed with the main rod and is inclined forward and upward relative to the main rod, and the second connecting rod is rotatably connected to the main rod, with a rotational range of the second connecting rod relative to the main rod being 8-10°.

5. The chair with improved comfort according to claim 1, wherein:

the transmission device comprises a rotating member, the rotating member is rotatably disposed relative to the backrest bracket, the transfer rod is rotatably connected to the rotating member, and the rotating member is configured to drive the transfer rod to move relative to the backrest bracket when the rotating member rotates relative to the backrest bracket.

6. The chair with improved comfort according to claim 5, wherein:

the transmission device further comprises a first connecting rod, a second connecting rod, an intermediate seat, and a swing rod; the intermediate seat is fixed relative to the backrest bracket and rotates synchronously with the backrest bracket relative to the base; one end of the first connecting rod is rotatably connected to the base; an upper end of the second connecting rod is rotatably connected to the other end of the first connecting rod; a lower end of the second connecting rod is rotatably connected to the intermediate seat; the swing rod is rotatably connected to the upper end of the second connecting rod; the rotating member is rotatably disposed on the intermediate seat; a front end of the rotating member is rotatably connected to the swing rod; a rear end of the rotating member is rotatably connected to the transfer rod;

wherein when the backrest bracket tilts backward, the backrest bracket rotates downward and backward relative to the base, the intermediate seat fixed to the backrest bracket also rotates synchronously, driving the second connecting rod to move downward and forward, the second connecting rod drives the first connecting rod to rotate downward and backward relative to the base, simultaneously pulling the swing rod to move forward and downward, the swing rod pulls the rotating member to rotate forward relative to the intermediate seat, thereby driving the transfer rod to move relative to the intermediate seat and the backrest bracket.

7. The chair with improved comfort according to claim 6, wherein:

the intermediate seat extends rearward to form a connecting seat, the connecting seat is hollow and forms a receiving slot, the rotating member is located in the receiving slot and is rotatably connected to the connecting seat via a rotating shaft.

8. The chair with improved comfort according to claim 6, wherein the rotating member is triangular in shape.

9. The chair with improved comfort according to claim 6, wherein:

the backrest bracket has an L-shaped structure, comprising a horizontal section and a vertical section; the horizontal section is located on left and right sides of the rear part of the base, with a front end of the horizontal section rotatably connected to a rear end of the base; support seats are fixedly provided on left and right sides of an upper end of a middle position of the horizontal section; the support seats are connected by a connecting beam; the connecting beam presses on the intermediate seat, so that when the backrest bracket rotates, the horizontal section can press down the intermediate seat through the connecting beam to rotate synchronously.

10. The chair with improved comfort according to claim 6, wherein:

the base comprises a bottom shell and a base seat member, the bottom shell is fixedly connected to the base seat member, the intermediate seat and the backrest bracket are both rotatably connected to the bottom shell, the first connecting rod is rotatably connected to the base seat member.

11. The chair with improved comfort according to claim 1, wherein:

the lower backrest is of a frame structure, the upper backrest comprises an upper backrest support body and an upper backrest frame, the upper backrest support body is fixedly connected to the upper backrest frame, the upper backrest support body is of a frame structure, and a lower end of the upper backrest frame is rotatably connected to an upper end of the backrest bracket.

12. The chair with improved comfort according to claim 11, wherein:

the upper backrest frame comprises a forward-extending third connecting rod, and the third connecting rod is fixedly connected to the upper backrest support body and is rotatably connected to an upper end of the transfer rod.

* * * * *